US006448516B1

(12) United States Patent
Chiang

(10) Patent No.: US 6,448,516 B1
(45) Date of Patent: Sep. 10, 2002

(54) VIBRATION DETECTING SWITCH

(76) Inventor: Ching An Chiang, 5Fl., No. 29, San Min St., Pu Ping Tsun, San Chih Hsian, Taipei Hsien (TW)

( * ) Notice: Subject to any disclaimer, the term of this patent is extended or adjusted under 35 U.S.C. 154(b) by 0 days.

(21) Appl. No.: 09/855,779

(22) Filed: May 16, 2001

(51) Int. Cl.[7] ..... H01H 35/02

(52) U.S. Cl. ..... 200/61.45 R; 200/61.52; 200/277

(58) Field of Search ..... 200/61.45 R, 61.48, 200/61.51–61.52, 61.53, DIG. 8, DIG. 9, DIG. 29, 277

(56) References Cited

U.S. PATENT DOCUMENTS 4,178,492 A * 12/1979 Roesch et al. ..... 200/61.45 R
4,751,353 A * 6/1988 Stephens ..... 200/277
4,766,275 A * 8/1988 Hemmann et al. ..... 200/153 A
5,610,590 A * 3/1997 Johnson et al. ..... 340/573
5,747,762 A * 5/1998 Fukuda et al. ..... 200/61.45 R
6,198,396 B1 * 3/2001 Frank ..... 340/573

FOREIGN PATENT DOCUMENTS

EP 762453 A1 * 3/1997
JP 09097545 * 4/1997
WO WO 9532514 A * 11/1995

* cited by examiner

*Primary Examiner*—P. Austin Bradley
*Assistant Examiner*—Lisa N Klaus
(74) *Attorney, Agent, or Firm*—Bacon & Thomas

(57) ABSTRACT

A vibration induction switch includes a metal bottom holder having a top center convex, a metal top holder matched with the metal bottom holder and having a bottom center convex, a metal ball received in between the metal bottom holder and the metal top holder to switch on the circuit when the vibration induction switch is maintained immovable, or to alternatively switch on/off the circuit when the vibration induction switch is moved.

2 Claims, 9 Drawing Sheets

VIBRATION DETECTING SWITCH

BACKGROUND OF THE INVENTION

The present invention relates to an electric switch and, more specifically, to a vibration detecting switch, in which a convex surface is provided to guide a metal ball radially outwards so that to keep the circuit on (or off) when the vibration detecting switch is maintained in balance.

A variety of vibration switches have been disclosed for use to detect the vibration of an object. However, these vibration switches cannot detect displacement of the object in which they are installed. In order to detect the displacement of the object in which a vibration switch is installed, a specially designed control circuit must be added to set the vibration switch into the on (or off) status when the object the maintained immovable.

SUMMARY OF THE INVENTION

The present invention has been accomplished to provided vibration detecting switch, which is practical to detect the vibration as well as displacement of the object in which the vibration detecting switch is installed. According to a first embodiment of the present invention, the vibration detecting switch comprises a metal bottom holder connected to one pole of power supply, the metal bottom holder comprising a top center convex surface and a plurality of top contact rods spaced around the top center convex surface, a metal top holder covered on the metal bottom holder and connected to the other pole of power supply, the metal top holder comprising a bottom center convex surface and a plurality of bottom contact rods spaced around the bottom center convex surface and respectively inserted in the gaps between each top contact rods of the metal bottom holder, a metal ball received in between the metal bottom holder and the metal top holder and disposed in contact with one top contact rod of the metal bottom holder and one bottom contact rod of the metal top holder to switch on the circuit when vibration detecting switch is maintained immovable. According to a second embodiment of the present invention, the vibration detecting switch comprises a metal top cover connected to one pole of power supply, the metal top cover having a bottom center convex surface, a corrugated inner peripheral wall spaced around the bottom convex surface, and two bottom contact rods downwardly extended from the bottom sidewall at two sides for connection to one pole of power supply, an electrically insulative base plate covered on the bottom sidewall of the metal top cover, the electrically insulative base plate having a top center recess and a center through hole through the top center recess, and a rod electrode mounted in the center through hole of the electrically insulative base plate and connected to the other pole of power supply, the rod electrode having a conical head fitted into the top center recess of the electrically insulative base plate and aimed at the bottom convex surface of the metal top cover, and a metal ball carried on the electrically insulative base plate inside the metal top cover to switch off the circuit when the vibration detecting switch is maintained immovable, or to intermittently touch the conical head of the electrode and the bottom convex surface of the metal top cover to further alternatively switch on/off the circuit.

DETAILED DESCRIPTION OF THE PREFERRED EMBODIMENT

Figure 1:
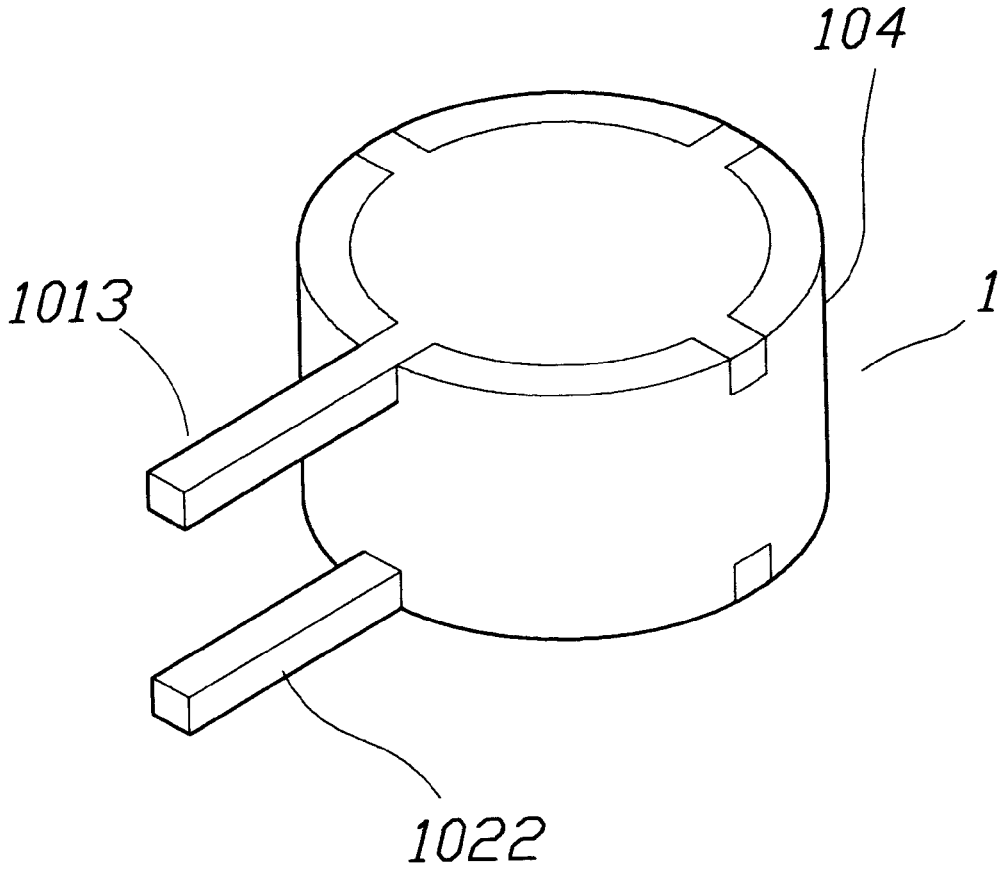
FIG. 1 is an elevational view of a vibration detecting switch according to a first embodiment of the present invention.
Figure 2:
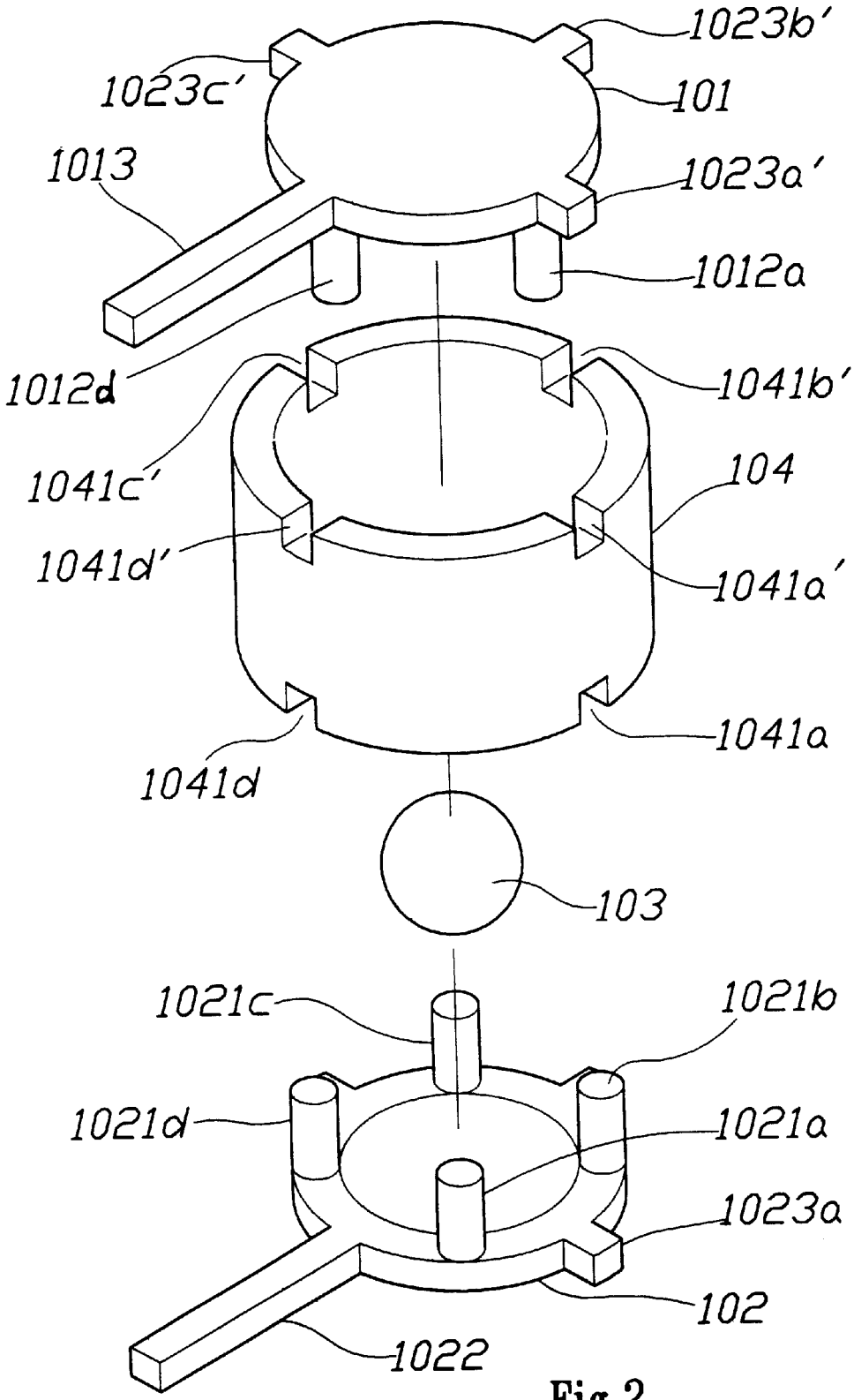
FIG. 2 is an exploded view of the vibration detecting switch shown in FIG. 1.
Figure 3:
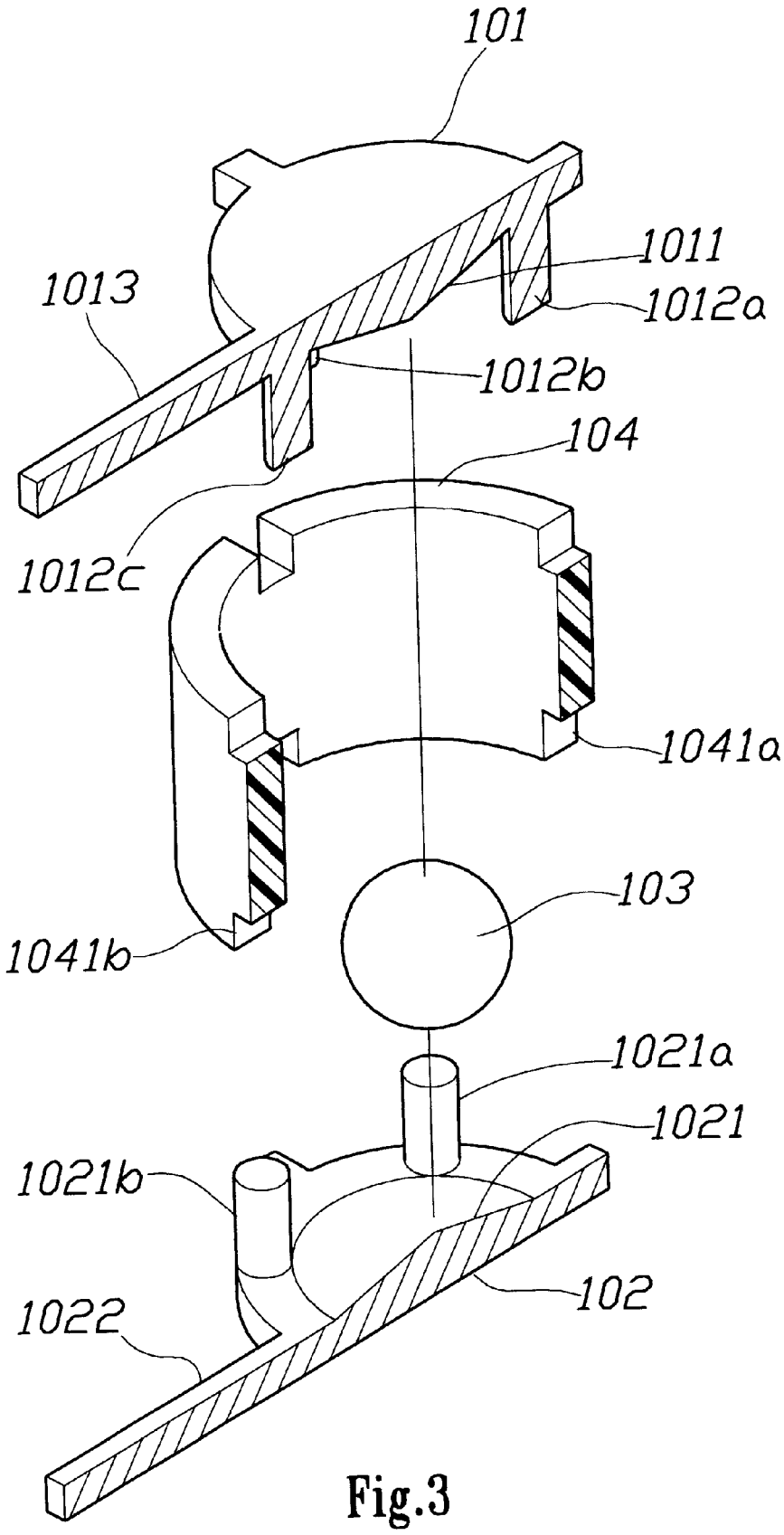
FIG. 3 is a cutaway view of FIG. 2.

Referring to FIGS. from 1 through 3, a vibration detecting switch 1 according to a first embodiment of the present invention is shown comprised of a metal top holder 101, a metal bottom holder 102, a metal ball 103 received in between the metal top holder 101 and the metal bottom holder 102, and an outer cover shell 104 holding the metal top holder 101, the metal bottom holder 102 and the metal ball 103 together. The metal top holder 101 has a bottom convex surface 1011 curved outwards from the center of the bottom sidewall thereof, a plurality of bottom contact rods 1012*a*, 1012*b*, 1012*c*, 1012*d* perpendicularly downwardly extended from the bottom surface and equiangularly spaced around the bottom convex surface 1011, and a conducting rod 1013 perpendicularly upwardly extended from the center of the top sidewall thereof. The metal bottom holder 102 comprises a top convex surface 1021 curved outwards from the center of the top sidewall thereof, a plurality of top contact rods 1022*a*, 1022*b*, 1022*c*, 1022*d* perpendicularly upwardly extended from the top sidewall and equiangularly spaced around the top convex surface 1021, two locating rods 1023*a*, 1023*b* respectively horizontally extended from the periphery in reversed directions, and a conducting rod 1022 perpendicularly extended from the center of the bottom sidewall thereof. The outer cover shell 104 fits over the metal top holder 101 and the metal bottom holder 102, comprising two bottom locating notches 1042*a*, 1042*b* disposed at two sides of the bottom opening thereof, and a top center through hole 1042.

Figure 4:
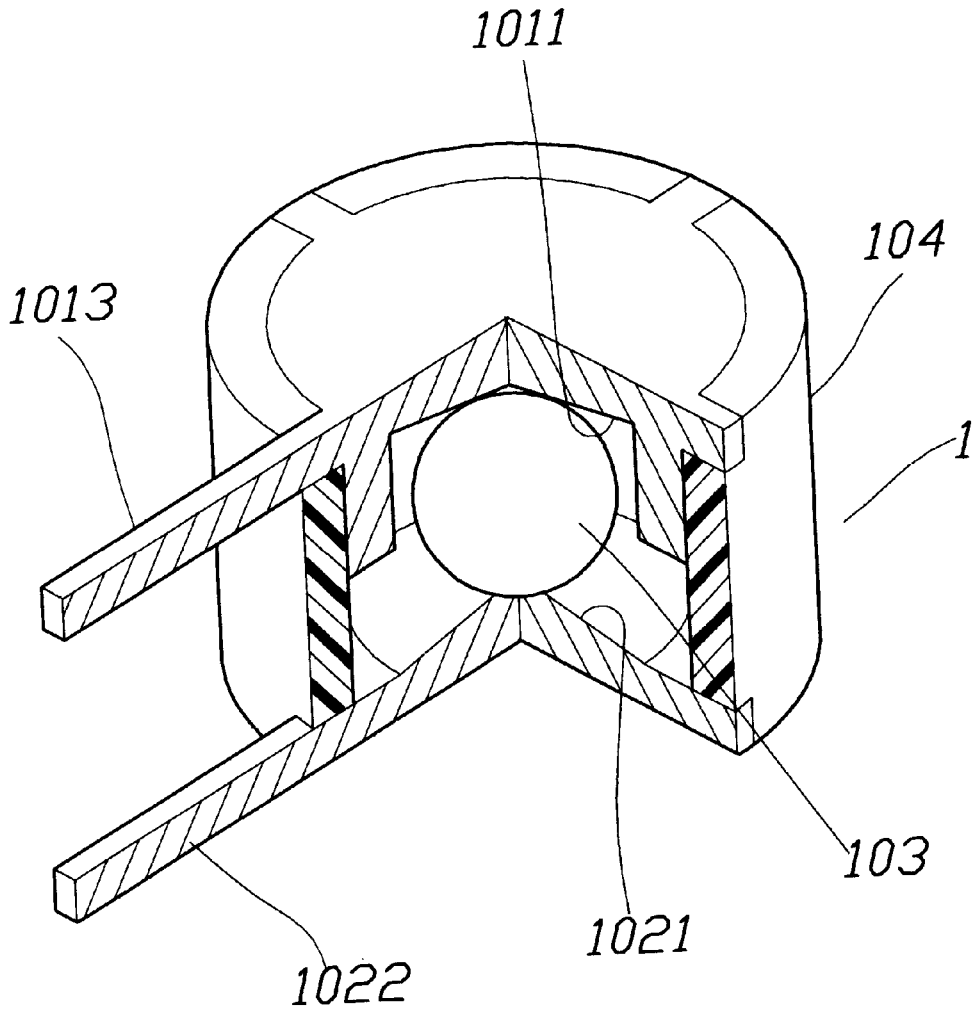
FIG. 4 is a sectional elevation of the vibration detecting switch shown in FIG. 1.
Figure 5:
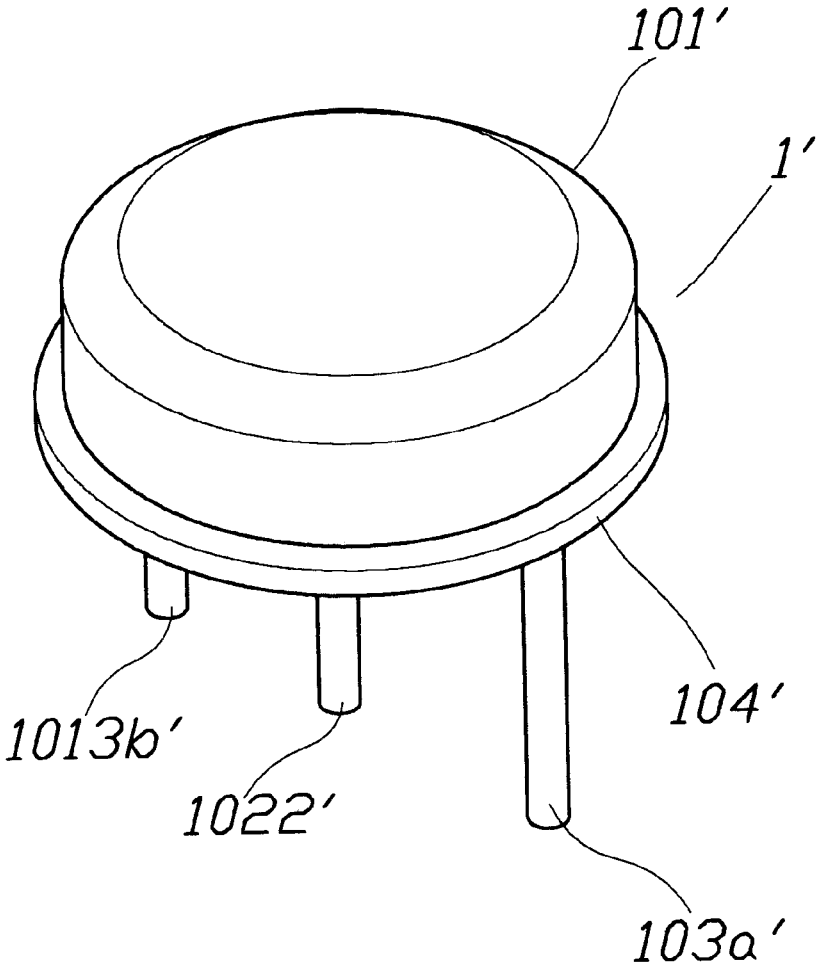
FIG. 5 is an elevational view of a vibration detecting switch according to a second embodiment of the present invention.
Figure 6:
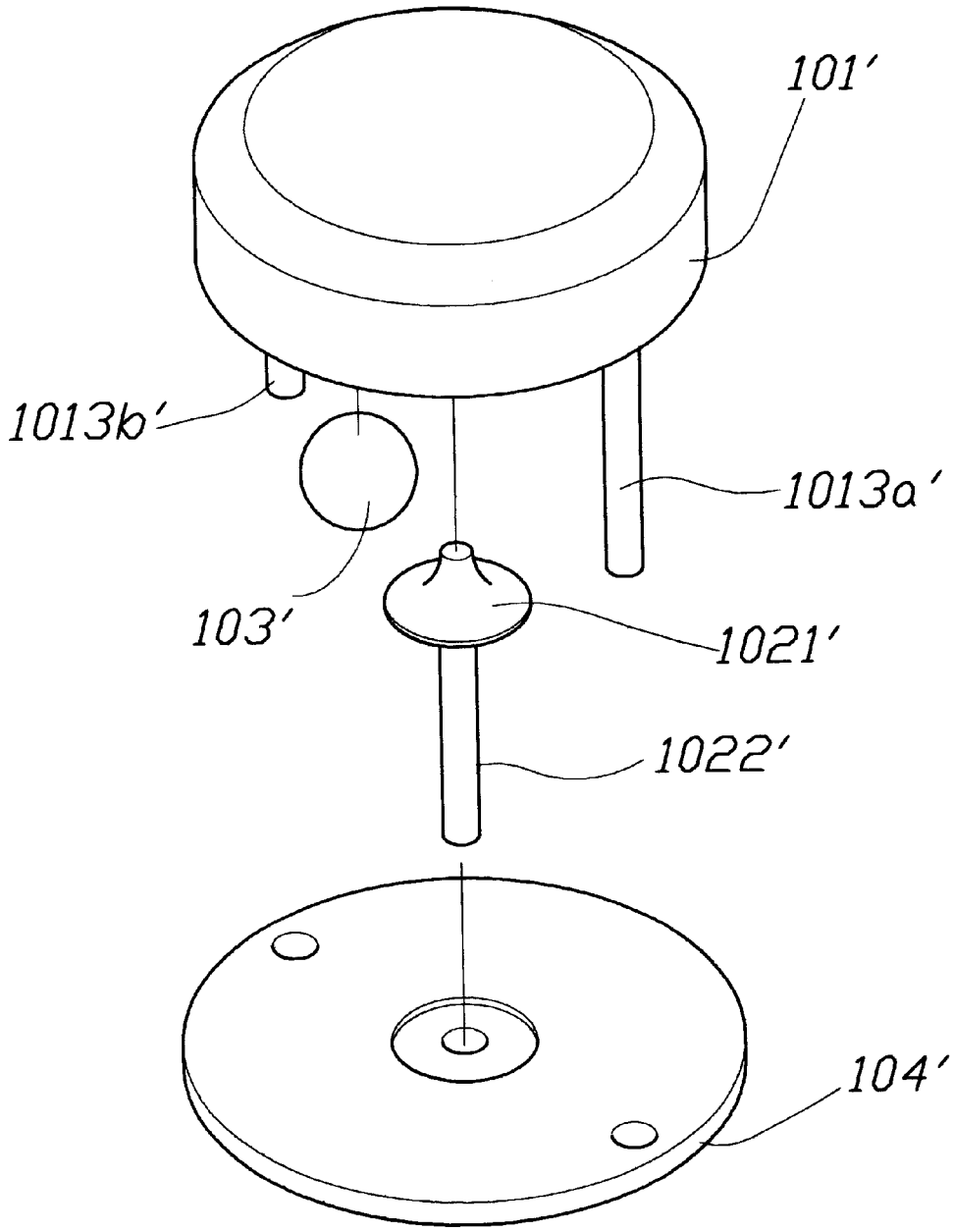
FIG. 6 is an exploded view of the vibration detecting switch shown in FIG. 5.
Figure 7:
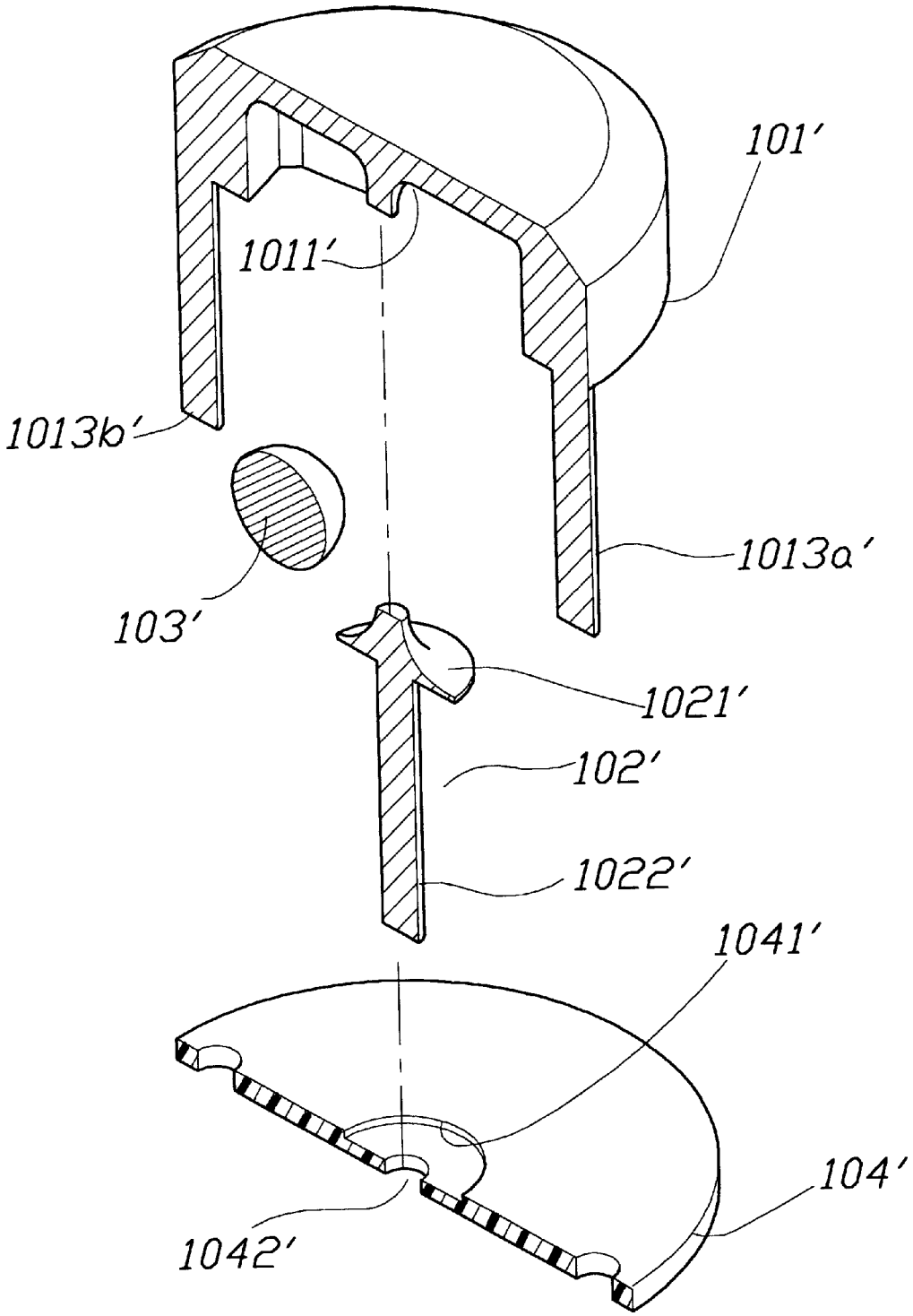
FIG. 7 is a cutaway view of FIG. 6.
Figure 8:
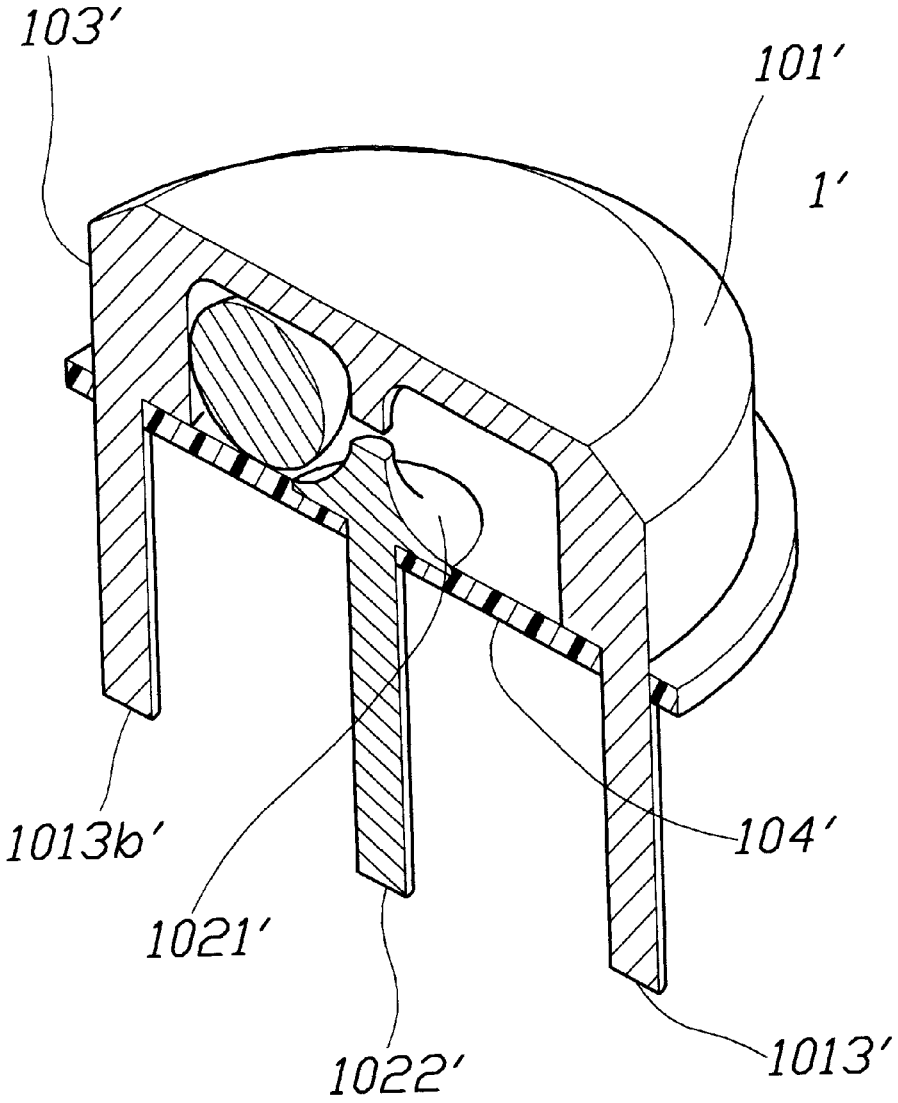
FIG. 8 is a sectional side elevation of the vibration detecting switch shown in FIG. 5.
Figure 9:
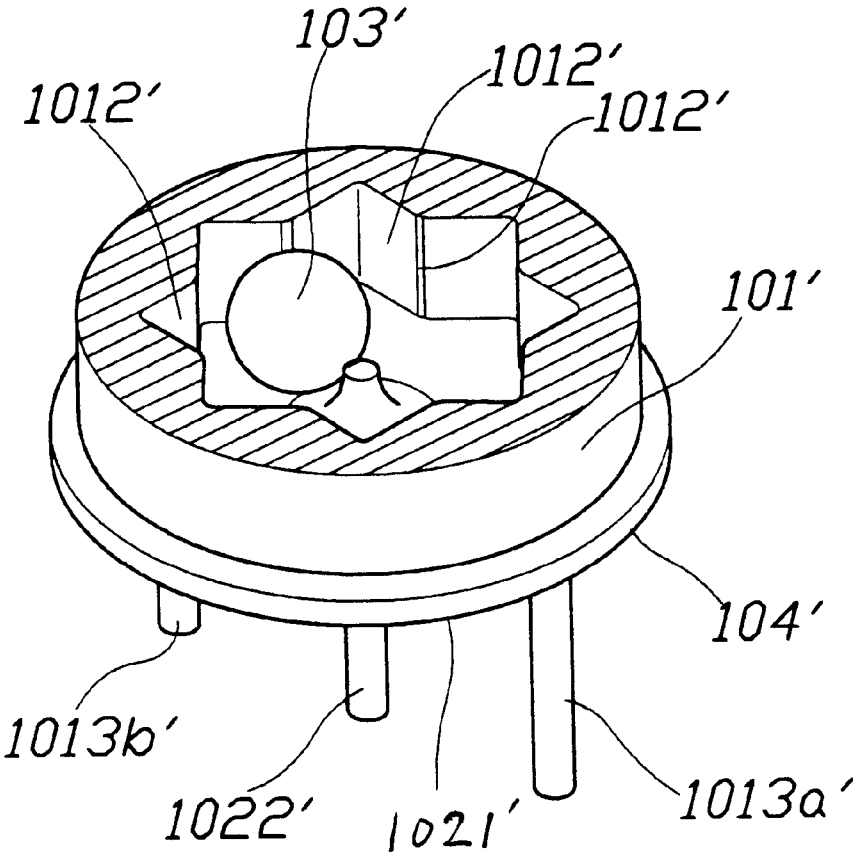
FIG. 9 is a sectional elevation of the vibration detecting switch according to the second embodiment of the present invention showing the internal structure of the metal top cover.

Referring to FIG. 4 and FIGS. from 1 through 3 again, the bottom contact rods 1012*a*, 1012*b*, 1012*c*, 1012*d* of the metal top holder 101 are respectively inserted in between the top contact rods 1022*a*, 1022*b*, 1022*c*, 1022*d* of the metal bottom holder 102, the metal ball 103 is received in between the metal top holder 101 and the metal bottom holder 102 and surrounded by the bottom contact rods 1012*a*, 1012*b*, 1012*c*, 1012*d* of the metal top holder 101 and the top contact rods 1022*a*, 1022*b*, 1022*c*, 1022*d* of the metal bottom holder 102, the conducting rod 1013 of the metal top holder 101 extends out of the outer cover shell 104 through the top center through hole 1042, and the conducting rod 1022 extends out of the open bottom side of the outer cover shell 104. In order to prevent rotary motion of the metal top holder 101 relative to the outer cover shell 104, the top center through hole 1042 is made having a non-circular, for example, rectangular cross section, and the conducting rod 1013 of the metal top holder 101 fits the rectangular cross section of the conducting rod 1013 of the metal top holder 101.

When in use in an apparatus, the conducting rod 1013 of the metal top holder 101 and the conducting rod 1022 of the metal bottom holder 102 are respectively connected to the positive terminal and negative terminal of an electric circuit installed in the apparatus. Because the bottom convex surface 1011 of the metal top holder 101 is aimed at the top convex surface 1021 of the metal bottom holder 102, the metal ball 103 falls to the border area and is disposed in contact with one of the bottom contact rods 1012*a*, 1012*b*, 1012*c*, 1012*d* of the metal top holder 101 and one of the top contact rods 1022*a*, 1022*b*, 1022*c*, 1022*d* of the metal bottom holder 102 to close the electric circuit. When moving the apparatus, the metal ball 103 is moved in between the metal top holder 101 and the metal bottom holder 102 to intermittently close/open the electric circuit, i.e., the electric circuit is off when the metal ball 103 moves away from the bottom contact rods 1012*a*, 1012*b*, 1012*c*, 1012*d* of the metal top holder 101 and the top contact rods 1022*a*, 1022*b*, 1022*c*, 1022*d* of the metal bottom holder 102, and the electric circuit is on when the metal ball 103 falls from the higher center area of the top convex surface 1021 to the border area to touch one of the bottom contact rods 1012*a*, 1012*b*, 1012*c*, 1012*d* of the metal top holder 101 and one of the top contact rods 1022*a*, 1022*b*, 1022*c*, 1022*d* of the metal bottom holder 102.

FIGS. from 5 through 9 show a vibration detecting switch 1' constructed according to a second embodiment of the present invention. The vibration induction switch 1' is comprised of a metal top cover 101', a rod electrode 102', a metal ball 103', and an electrically insulative base plate 104'. The metal top cover 101' is shaped like a cap having a bottom convex surface 1011' curved outwards from the bottom sidewall thereof, a corrugated inner peripheral wall 1012' spaced around the bottom convex surface 1011', and two bottom contact rods 1013*a*', 1013*b*' downwardly extended from the bottom sidewall thereof at two sides. The electrically insulative base plate 104' is sleeved onto the bottom contact rods 1013*a*', 1013*b*' and covered on the bottom sidewall of the metal top cover 101' to hold the metal ball 103' on the inside of the metal top cover 101', having a top center recess 1041', and a center through hole 1042' through the center of the top center recess 1041'. The rod electrode 102' comprises a shank 1022' inserted through the center through hole 1042' of the electrically insulative base plate 104' and extended to the outside of the metal top cover 101', and a generally conical head 1021' which has a generally conical profile and is fitted into the top center recess 1041' of the electrically insulative base plate 104' and aimed at the bottom convex surface 1011' of the metal top cover 101'. When in use, the bottom contact rods 1013*a*', 1013*b*' of the metal top cover 101' and the shank 1022' of the electrode 102' are respectively connected to the positive pole and negative pole of power supply. Because the head 1021' of the electrode 102' has a generally conical profile, the metal ball 103' does not stay at the generally conical head 1021' and automatically moves to the corrugated inner peripheral wall 1012' when the apparatus in which the vibration detecting switch 1' is installed is maintained immovable, and at this time the circuit is off. On the contrary, when the apparatus in which the vibration detecting switch 1' is moved, the metal ball 103' is forced to move in the metal top cover 101' to intermittently touch the generally conical head 1021' of the electrode 102' and the bottom convex surface 1011' of the metal top cover 101' and therefore the circuit is alternatively switched on and off.

A prototype of vibration detecting switch has been constructed with the features of FIGS. 1~9. The vibration detecting switch functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A vibration detecting switch comprising:

a metal bottom holder, said metal bottom holder comprising a top sidewall, a bottom sidewall, a top convex surface curved outwards from a center portion of the top sidewall, a plurality of top contact rods perpendicularly upwardly extended from the top sidewall and equiangularly spaced around said top convex surface, two locating rods respectively horizontally extended from a periphery of the metal bottom holder in different directions, and a conducting rod horizontally extended from the periphery of the metal bottom holder for connection to one pole of a power supply;

a metal top holder covering said metal bottom holder, said metal top holder comprising a top sidewall, a bottom sidewall, a bottom convex surface curved outwards from a center of the bottom sidewall, a plurality of bottom contact rods perpendicularly downwardly extended from the bottom sidewall and equiangularly spaced around said bottom convex surface and respectively inserted in between each two of said top contact rods of said metal bottom holder, a horizontal conducting rod extended from a periphery of the metal top holder for connection to a second pole of the power supply, and a plurality of horizontal lugs equiangularly spaced around the periphery of the metal top holder;

a metal ball received in between said metal bottom holder and said metal top holder and disposed in contact with one top contact rod of said metal bottom holder and one bottom contact rod of said metal top holder when the vibration detecting switch is maintained immovable; and an outer cover shell positioned between said metal bottom holder and said metal top holder, said outer cover shell comprising two bottom locating notches respectively engaged with the locating rods of said metal bottom holder, two top locating notches respectively engaged with the locating rods of said metal top holder, and holes which receive the respective conducting rods of said metal bottom holder and said metal top holder.

2. A vibration detecting switch comprising:

a metal top cover, said metal top cover having a bottom convex surface curved outwards from a bottom sidewall thereof, a corrugated inner peripheral wall spaced around said bottom convex surface, and two bottom contact rods downwardly extended from the bottom sidewall at two sides for connection to one pole of power supply;

an electrically insulative base plate sleeved onto the bottom contact rods of said metal top cover and covering the bottom sidewall of said metal top cover, said electrically insulative base plate having a top center recess, and a center through hole through the center of said top center recess;

a rod electrode mounted in said electrically insulative base plate, said rod electrode comprising a shank inserted through a center through hole of said electrically insulative base plate for connection to one pole of a power supply, and a conical head fitted into a top center recess of said electrically insulative base plate and aimed at the bottom convex surface of said metal top cover; and a metal ball carried on said electrically insulative base plate inside said metal top cover to switch off the circuit when the vibration detecting switch is maintained immovable, or to intermittently touch the conical head of said electrode and the bottom convex surface of said metal top cover to further alternatively switch on/off the circuit.

* * * * *